United States Patent [19]

Goldman et al.

[11] Patent Number: 4,566,720

[45] Date of Patent: Jan. 28, 1986

[54] BOOKLET WITH DETACHABLE ENVELOPE

[75] Inventors: Michael B. Goldman, Deerfield; Frederick Price, Chicago, both of Ill.

[73] Assignee: The Wessel Company, Elk Grove Village, Ill.

[21] Appl. No.: 574,459

[22] Filed: Jan. 27, 1984

[51] Int. Cl.[4] ..... B42D 1/00; B41L 1/20; B65D 27/06

[52] U.S. Cl. ..... 281/15 R; 281/3 R; 282/11.5 R; 282/25; 283/1 B; 283/64; 229/73; 229/92.1; 229/92.3

[58] Field of Search ..... 281/15 R, 29, 31, 3 R; 282/11.5 R, 25; 283/1 B, 51, 63 R, 64, 105, 56; 229/70, 71, 73, 92.1, 92.3

[56] References Cited

U.S. PATENT DOCUMENTS

| | | | |
|---|---|---|---|
| 1,089,486 | 3/1914 | Levine | 283/1 B |
| 2,145,500 | 1/1939 | Townsend | 281/3 R |
| 3,460,744 | 8/1969 | Turkenkopf | 229/92.1 |
| 3,665,817 | 5/1972 | Katz et al. | 281/3 R |
| 3,713,673 | 1/1973 | Katz | 281/3 R |
| 3,718,277 | 2/1973 | Volkert | 229/73 |
| 3,743,273 | 7/1973 | Katz et al. | 412/2 X |
| 3,803,835 | 2/1975 | Gendron | 229/70 X |
| 3,858,792 | 1/1975 | Volkert | 229/73 |
| 3,941,309 | 3/1976 | Gendron | 229/73 |

FOREIGN PATENT DOCUMENTS

| | | | |
|---|---|---|---|
| 0901533 | 5/1972 | Canada | 229/73 |
| 1386131 | 3/1975 | United Kingdom | 281/3 R |

*Primary Examiner*—Paul A. Bell
*Assistant Examiner*—Taylor J. Ross
*Attorney, Agent, or Firm*—Marshall, O'Toole, Gerstein, Murray & Bicknell

[57] ABSTRACT

A booklet comprises a front page, a back page and a plurality of inner pages. An envelope is detachably connected to the outer longitudinal edge of the booklet's back page, and the envelope has dimensions which permit it to be folded along either the outside or the inside of the back page. The envelope may be folded inside the booklet without impairing the compactness of the booklet. No matter how the envelope is folded, there is easy access to all of the booklet pages and to the envelope. For functional reasons involving the aforesaid compactness and accessibility, the back page is indented relative to the other pages of the booklet and the front and back panels of the envelope are indented relative to the back page of the booklet. The envelope has a flap made out of material saved from the indentations.

11 Claims, 6 Drawing Figures

BOOKLET WITH DETACHABLE ENVELOPE

BACKGROUND OF THE INVENTION

The present invention relates generally to printed material and more particularly to a printed booklet with detachable envelope.

A typical use for a booklet with detachable envelope is as a catalog with return mailer attached thereto. These catalogs are distributed to consumers by inserting them in magazines or other periodicals or by stuffing them in envelopes with other material mailed to consumers, and the like. The nature of the product requires that it be small, thin, compact and inexpensive to produce. The product should be attractive, invite the recipient to examine the printed contents thereof and facilitate utilization of the detachable envelope for return mailing purposes. All parts of the booklet should be easily accessible.

SUMMARY OF THE INVENTION

In accordance with the present invention there is provided a printed booklet with detachable envelope having a number of desirable features. The product is small, thin and compact to facilitate insertion or stuffing.

The booklet consists of a plurality of pages all of which are easily accessible. A detachable envelope is attached to the last page of the booklet, and the envelope is easily accessible. There is versatility and flexibility with regard to the location of the envelope relative to the rest of the booklet. The envelope may be folded within the booklet for total enclosure of the envelope, e.g., during distribution of the booklet, or the envelope may be folded on the outside of the booklet to expose the envelope to the consumer. The envelope may be easily enclosed within the booklet without substantially modifying the compactness of the booklet.

The product is designed so that it may be manufactured without complex manufacturing steps, yet it constitutes an attractive and highly functional manufactured product. The product is composed of paper and is designed to minimize material waste during the manufacturing process.

Other features and advantages are inherent in the product claimed and disclosed or will become apparent to those skilled in the art from the following detailed description in conjunction with the accompanying diagrammatic drawings.

DETAILED DESCRIPTION

Figure 4:
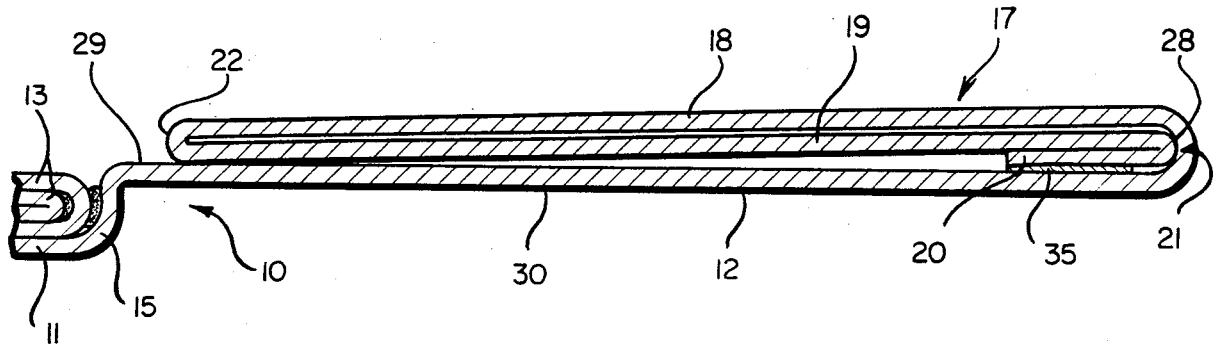
FIG. 4 is a sectional view taken along line 4—4 in FIG. 3.
Figure 5:
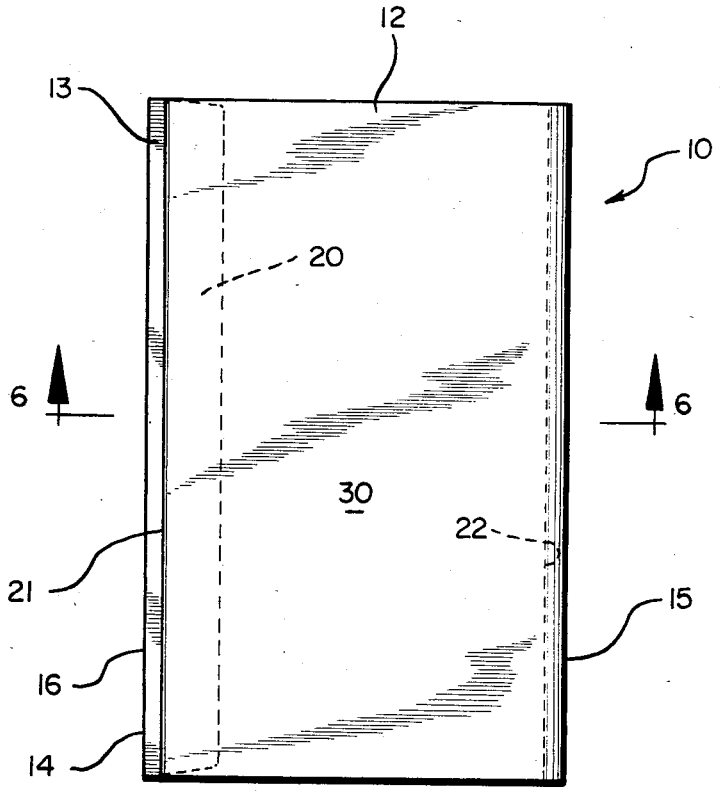
FIG. 5 is a plan view showing the back page closed and the envelope folded along the inside of the back page.
Figure 6:
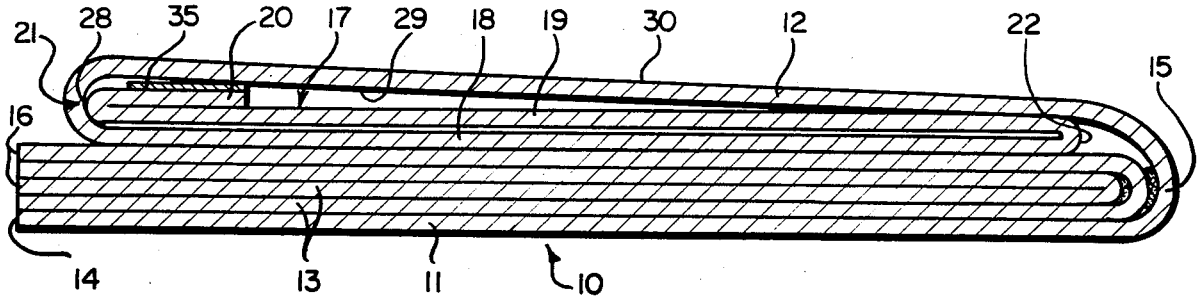
FIG. 6 is a sectional view taken along line 6—6 in FIG. 5.

In the drawings, the thickness of the various parts of the booklet is exaggerated in the sectional views (FIGS. 2, 4 and 6), and this tends to distort the relative lateral dimensions in those views. Therefore, the relative lateral dimensions of the various booklet parts are best shown in the plan views.

Referring now to the drawings, indicated generally at 10 is a booklet with detachable envelope constructed in accordance with an embodiment of the present invention. Booklet 10 comprises a front page 11, a back page 12 and a plurality of inner pages 13, 13. Each of pages 11–13 is longitudinally coextensive with the other pages, and each has inner and outer longitudinal edges which will be more fully described below. All of the inner longitudinal page edges are secured together, as by adhesive, along a spine 15 of booklet 10. Front page 11 has an outer longitudinal edge 14, and inner pages 13, 13 have outer longitudinal edges 16, 16. All of the outer longitudinal edges 14 and 16, 16 are free and unattached. Back page 12 has an inside surface 29 and an outside surface 30.

Indicated generally at 17 is a detachable envelope forming part of booklet 10. Envelope 17 has a back panel 18, a front panel 19 and a flap 20. Each of envelope panels 18, 19 has a pair of lateral edges and first and second longitudinal edges, all of which will be described in greater detail below. Panels 18, 19 and flap 20 are longitudinally coextensive with each other and with the booklet pages.

Envelope back panel 18 is detachably secured to the booklet's back page 12 along a perforated fold line 21 also defining the outer longitudinal edge of back page 12 and the first longitudinal edge of back panel 18. Perforated fold line 21 constitutes structure for folding envelope 17 into a position alongside either inside surface 29 of back page 12 (FIGS. 3–6) or alongside outside surface 30 of the back page (FIGS. 1 and 2).

The envelope's back panel 18 and front panel 19 are joined at a longitudinal fold line 22 defining the second longitudinal edge of each envelope panel. Back panel 18 and front panel 19 are secured together adjacent their lateral edges, as by glue 25, to form the lateral edges 23, 24 of envelope 17 (FIG. 1).

Flap 20 is longitudinally coextensive with envelope panels 17, 18, and flap 20 is joined to front panel 19 at a longitudinal fold line 28 defined by the first longitudinal edge of front panel 19. Flap 20 is normally folded back alongside the exposed or outside surface of front panel 19.

Figure 1:
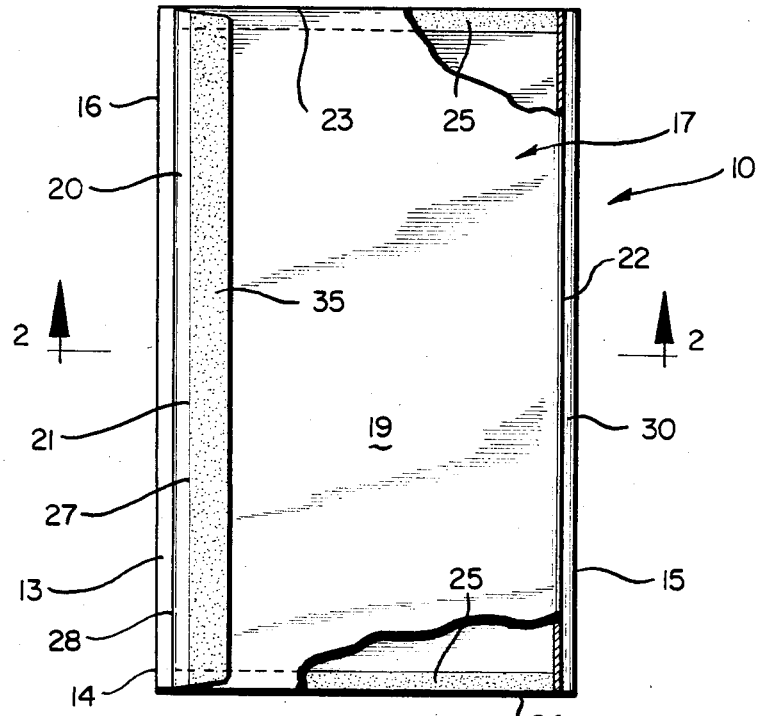
FIG. 1 is a plan view of a booklet with detachable envelope constructed in accordance with an embodiment of the present invention and showing the booklet closed and the envelope folded along the outside of the booklet's back page.
Figure 2:
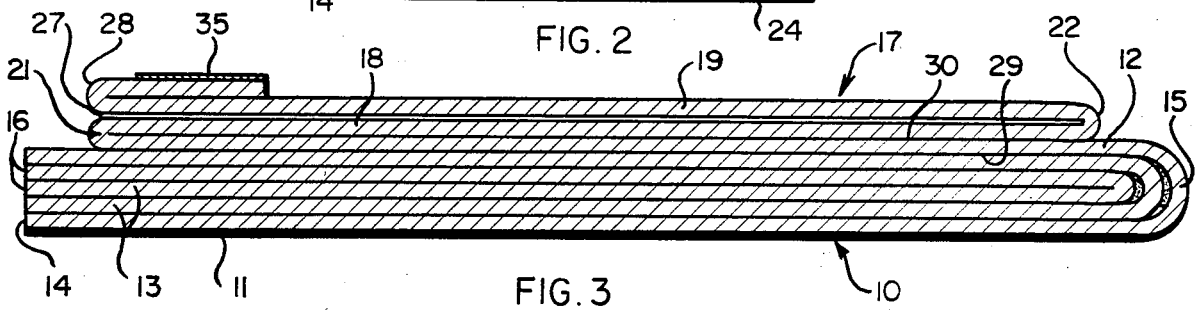
FIG. 2 is a sectional view taken along line 2—2 in FIG. 1.
Figure 3:
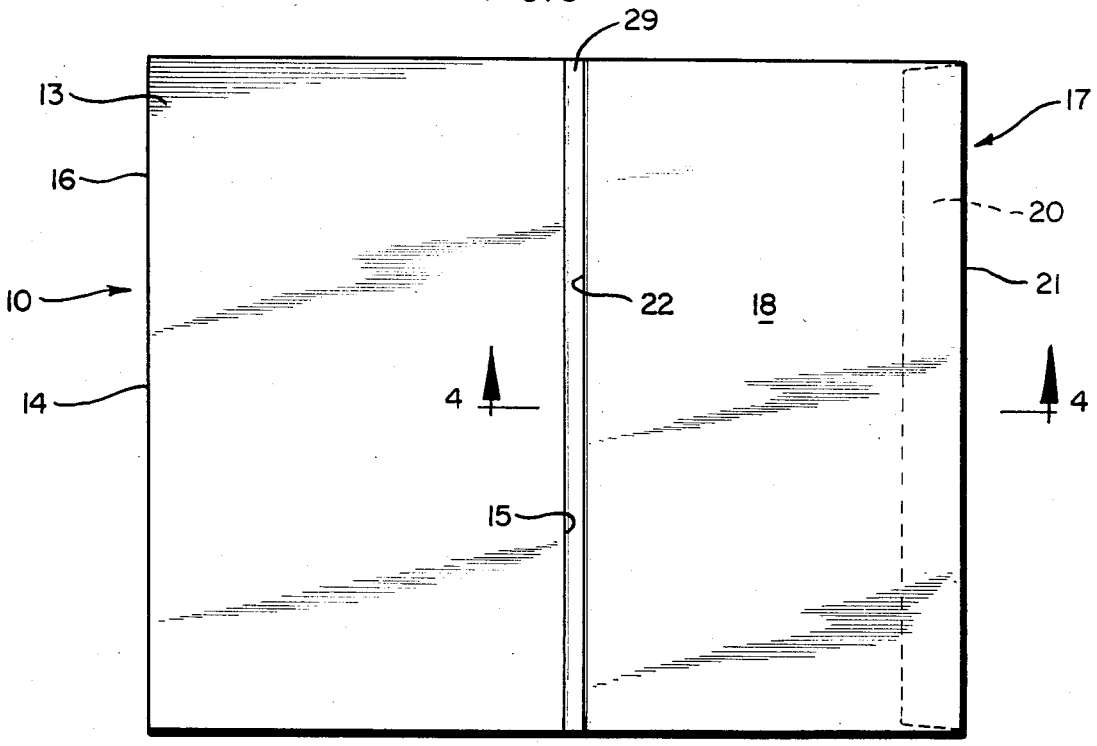
FIG. 3 is a plan view showing the back page opened and the envelope folded on the inside of the back page of the booklet.

There is an envelope opening 27 adjacent first longitudinal edge 21 of back panel 18 (FIGS. 1 and 2). Envelope flap 20 is gummed, in a conventional manner at 35, for sealing the envelope when the flap is folded over the back panel to close opening 27.

As noted above, all of the booklet pages 11, 12, 13 and all of the envelope parts 18, 19, 20 are longitudinally coextensive. In addition, each booklet page and each envelope part has a constant lateral dimension along its entire length. All of this simplifies the manufacturing operation and reduces the cost of the product.

In a typical embodiment, the booklet has a longitudinal dimension of about $6\frac{1}{4}''$ which is the length of all the booklet pages 11–13 as well as the length of envelope panels 18, 19 and envelope flap 20. Booklet front page 11 and inner pages 13, 13 are laterally coextensive. Booklet back page 12 has a lateral dimension which is less than the lateral dimension of front page 11 and inner page 13, 13. In the embodiment described in the first sentence of this paragraph, the lateral dimension of booklet front page 11 and of inner pages 13, 13 is $3\frac{5}{8}''$, and in that embodiment, the lateral dimension of back page 12 would be $3\frac{1}{2}''$, for example.

Therefore, when back page 11 is folded closed, and envelope 17 is folded alongside inside surface 29 of the back page (FIGS. 5 and 6), perforated fold line 21 is indented relative to the respective outer longitudinal edges 14, 16 of the front page and inner booklet pages, there being, e.g., about a $\frac{1}{8}''$ indentation in the embodiment described above. This facilitates thumbing for easy access to envelope 17 and to front page 12 and inner pages 13, 13.

Envelope 17 has a lateral dimension, defined by the lateral distance between the back panel's first and second longitudinal edges 21, 22, respectively, which is less than the lateral dimension of the back page 12. As a result, when back page 12 is closed and envelope 17 is folded alongside inside surface 29 of back page 12 (FIGS. 5 and 6), the envelope's longitudinal fold line 22 is indented relative to all the inner longitudinal edges of the booklet pages, at spine 15. This facilitates closing of the booklet. More particularly, the indentation described in the next to last sentence enhances the compactness of the booklet when the envelope is folded inside the back page in the manner described above. Absent this indentation, there would be trouble obtaining a clean fold of the envelope within the booklet, and the envelope could be bowed rather than lying flat.

Envelope 17 may also be folded alongside outside surface 30 of back page 12 (FIGS. 1 and 2). When the last page is folded closed, and the envelope is folded alongside the back page's outside surface 30, perforated fold line 21 is indented relative to outer longitudinal edges 14 and 16 of the front page and inner booklet pages respectively. This facilitates thumbing for easy access to the front page and the inner pages when the envelope is folded on the outside of the back page.

In addition to all of the above, when back page 12 is closed, and the envelope is folded alongside outside surface 30 of back page 12, the envelope's longitudinal fold line 22 is indented relative to spine 15 of booklet 10. This indentation would also be about $\frac{1}{8}''$ for a booklet having the dimensions described above. This indentation facilitates thumbing of the envelope for easy access thereto.

Front and back pages 11, 12, envelope panels 18, 19 and envelope flap 20 are all manufactured from the same strip of paper which is separated into these component parts by longitudinal fold lines at 15, 21, 22 and 28. As noted above, back page 12 has a lateral dimension which is slightly less (e.g., $\frac{1}{8}''$) than the lateral dimension of front page 11. Similarly, each of envelope panels 18, 19 (which are laterally coextensive) has a lateral dimension which is slightly less than the lateral dimension of back page 12 (e.g., $\frac{1}{8}''$ for each of the envelope panels). The sum of (a) the difference in the lateral dimension between the back page and the front page, (b) the difference in lateral dimension between the envelope's front panel and the back page and (c) the difference in lateral dimension between the envelope's back panel and the back page is at least as large as the lateral dimension of envelope flap 20 (e.g., $\frac{5}{8}''$). This saves paper during manufacturing. In other words, the paper used to provide envelope flap 20 is taken from back page 12 and envelope flaps 19, 20 when providing each with their respective indentations which also perform other functions as noted above.

In summary, the present invention provides a booklet with detachable envelope wherein there is easy access to the envelope and all of the booklet pages. The product is versatile and flexible with respect to the enclosure of the envelope within the booklet or the exposure of the envelope on the exterior of the booklet. The envelope may be enclosed within the booklet utilizing a clean fold and without impairing the compactness of the booklet.

Because all of the pages and all parts of the envelope are longitudinally coextensive and because each page and each envelope part has a constant lateral dimension alongs its entire length, the manufacturing operation for producing the booklet is simplified. Because all the functionally mandated differences in lateral dimension are accommodated by incorporation of these dimension differentials into the lateral dimension of the flap of the envelope, there is no waste of material during the manufacturing process.

The foregoing detailed description has been given for clearness of understanding only, and no unnecessary limitations should be understood therefrom, as modifications will be obvious to those skilled in the art.

We claim:

1. A booklet comprising:

a front cover page;

a back cover page;

a plurality of inner pages;

each page being longitudinally coextensive with the other pages and having inner and outer longitudinal edges;

means securing together all of said inner longitudinal edges along a spine of said booklet;

the outer longitudinal edges of one cover page and of said inner pages being free and unattached;

and a detachable envelope having a back panel, a front panel and a flap;

each of said panels having a pair of lateral edges and first and second longitudinal edges;

said panels being longitudinally coextensive with each other;

the back panel of the envelope being detachable secured to the other cover page of the booklet along a perforated fold line also defining the outer longitudinal edge of the booklet's other cover page and the first longitudinal edge of the envelope's back panel;

said perforated fold line constituting means for folding the envelope into a folded position, when the booklet is closed, on the inside of the other cover page and means for folding the envelope into a folded position, when the booklet is closed, on the outside of the other cover page;

said front panel and said back panel being joined at a longitudinal fold line defining the second longitudinal edge of each;

means securing said front panel to said back panel adjacent their lateral edges;

an envelope opening adjacent the first longitudinal edge of the back panel;

said flap being longitudinally coextensive with said panels and joined to the front panel at a longitudinal fold line defined by the first longitudinal edge of the front panel;

said other cover page having a lateral dimension which is less than the lateral dimension of the one cover page and of the inner pages;

said envelope having a lateral dimension, defined by the lateral distance between the first and second longitudinal edges of the back panel, which is less than the lateral dimension of said other cover page;

the lateral distance between said spine and said perforated fold line being less than the lateral dimension of the one cover page and the inner pages and greater than the lateral dimension of said envelope;

said perforated fold line being indented relative to the outer longitudinal edges of the one cover page and the inner pages, when the other cover page is folded closed and the envelope is folded on the inside of the other cover page, to facilitate thumbing for easy access to the envelope and to the one cover page and inner pages.

2. A booklet as recited in claim 1 wherein:

said perforated fold line is indented relative to the outer longitudinal edges of the one cover page and the inner pages, when the other cover page is folded closed and the envelope is folded on the outside of the other cover page, to facilitate thumbing for easy access to the one cover page and inner pages.

3. A booklet as recited in any of the preceding claims wherein:

the envelope's longitudinal fold line is indented relative to all the inner longitudinal edges of the booklet pages, when the other cover page is closed and the envelope is folded inside the other cover page, to facilitate closing of the booklet.

4. A booklet as recited in any of claims 1 or 2 wherein:

the envelope's longitudinal fold line is indented relative to the spine of the booklet, when the other cover page is closed and the envelope is folded outside the other cover page, to facilitate thumbing of the envelope for easy access thereto.

5. A booklet as recited in any of claims 1 or 2 wherein:

the sum of the (a) the difference in lateral dimension between the other cover page and the one cover page, (b) the difference in lateral dimension between the envelope's front panel and said other cover page and (c) the difference in lateral dimension between the envelope's back panel and the other cover page is at least as large as the lateral dimension of said envelope flap.

6. A booklet as recited in claim 1 wherein:

said front and back envelope panels are laterally coextensive.

7. A booklet as recited in claim 1 wherein:

said envelope flap is folded back alongside said front panel.

8. A booklet as recited in claim 1 wherein:

said envelope panels are longitudinally coextensive with said booklet pages.

9. A booklet as recited in claim 1 wherein:

said one cover page and said inner pages have the same lateral dimension.

10. A booklet comprising:

a front cover page;

a back cover page;

a plurality of inner pages;

each page being longitudinally coextensive with the other pages and having inner and outer longitudinal edges;

means securing together all of said inner edges along a spine of said booklet;

the outer longitudinal edges of one cover page and of said inner pages being free and unattached;

and a detachable envelope having a back panel, a front panel and a flap;

each of said panels having a pair of lateral edges and first and second longitudinal edges;

said panels being longitudinally coextensive with each other;

the back panel of the envelope being detachably secured to the other cover page of the booklet along a perforated fold line also defining the outer longitudinal edge of the booklet's other cover page and the first longitudinal edge of the envelope's back panel;

said perforated fold line constituting means for folding the envelope into a folded position on the inside of the other cover page, and means for folding the envelope into a folded position on the outside of the other cover page;

said front panel and said back panel being joined at a longitudinal fold line defining the second longitudinal edge of each;

means securing said front panel to said back panel adjacent their lateral edges;

an envelope opening adjacent the first longitudinal edge of the back panel;

said flap being longitudinally coextensive with said panels and joined to the front panel at a longitudinal fold line defined by the first longitudinal edge of the front panel;

said other cover page having a lateral dimension which is less than the lateral dimension of the one cover page and of the inner pages;

said envelope having a lateral dimension, defined by the lateral distance between the first and second longitudinal edges of the back panel, which is less than the lateral dimension of said other cover page;

the lateral distance between said spine and said perforated fold line being less than the lateral dimension of the one cover page and the inner pages and greater than the lateral dimension of said envelope;

said perforated fold line being indented relative to the outer longitudinal edges of the one cover page and the inner pages, when the other cover page is folded closed and the envelope is folded on the outside of the other cover page, to facilitate thumbing for easy access to the one cover page and inner pages.

11. A booklet as recited in claim 10 wherein:

said envelope flap is folded back alongside said front panel.

* * * * *